US010028625B2

(12) United States Patent
Tarlton

(10) Patent No.: US 10,028,625 B2
(45) Date of Patent: Jul. 24, 2018

(54) OVER A SINK RETRACTABLE AND EXTENDABLE TOWEL HANGING APPARATUS

(71) Applicant: Marion J Tarlton, Garrett, IN (US)

(72) Inventor: Marion J Tarlton, Garrett, IN (US)

( * ) Notice: Subject to any disclaimer, the term of this patent is extended or adjusted under 35 U.S.C. 154(b) by 0 days.

(21) Appl. No.: 15/372,824

(22) Filed: Dec. 8, 2016

(65) Prior Publication Data

US 2018/0160866 A1 Jun. 14, 2018

(51) Int. Cl.

| | |
|---|---|
| ***A47B 53/00*** | (2006.01) |
| ***A47K 10/04*** | (2006.01) |
| ***D06F 57/00*** | (2006.01) |

(52) U.S. Cl.

CPC ..... *A47K 10/04* (2013.01); *D06F 57/00* (2013.01)

(58) Field of Classification Search

CPC ..... A47K 10/08; A47K 1/09; A47K 10/04; D06F 57/00; E03C 2001/0415

USPC ..... 211/16, 6, 41.4–41.6, 1.3; 4/654, 549, 4/551, 553, 567, 570, 638; 239/280, 239/280.5, 281, 428.5; 137/801; 248/326, 333, 175, 80, 81

See application file for complete search history.

(56) References Cited

U.S. PATENT DOCUMENTS 526,390 A * 9/1894 Glauber ..... E03C 1/186 15/160
758,770 A * 5/1904 McCann ..... A47K 1/06 220/495.01
1,193,302 A * 8/1916 Seltner ..... E03C 1/06 137/625.47
1,371,295 A * 3/1921 Brigham ..... A47K 10/025 211/6
1,406,030 A * 2/1922 Kelly ..... E03C 1/18 137/359
1,476,027 A * 12/1923 Bauck ..... A47K 10/08 211/96
1,494,883 A * 5/1924 Bassette ..... A47K 10/48 219/201
2,012,154 A * 8/1935 Bates ..... A47K 1/02 4/554

(Continued)

FOREIGN PATENT DOCUMENTS

| | | |
|---|---|---|
| JP | 11-253334 A | 9/1999 |
| JP | 2006055405 A | 3/2006 |
| JP | 2008000299 A | 1/2008 |

*Primary Examiner* — Abigail E Troy
*Assistant Examiner* — Devin K Barnett
(74) *Attorney, Agent, or Firm* — George Pappas

(57) ABSTRACT

A towel bar/hanging apparatus includes a sleeve extending through a horizontal surface of a sink rim and/or countertop is located adjacent a sink. An elongate arm is slidingly received through the sleeve. The arm is slidable through the sleeve to an extended position over the sink and to a retracted position below the horizontal surface. In its extended position, towels can be draped over the arm for drying and water dripping therefrom falls into the sink. In its extended position, the arm is prevented from unintentionally falling into its retracted position. The arm can comprise a pair of elongate links hingedly secured together, whereby one link is pivotable relative to the other for extending over the sink. The sleeve is preferably secured to a base flange secured atop the horizontal surface. The base flange can include a sprayer head hose.

5 Claims, 12 Drawing Sheets

(56) References Cited

U.S. PATENT DOCUMENTS 2,141,347 A * 12/1938 Davis ..... A47K 10/08 211/105.1
RE21,143 E * 7/1939 Davis ..... A47K 10/08 211/105.1
2,200,503 A * 5/1940 Held ..... E03C 1/0404 239/23
2,607,043 A * 8/1952 Brannam ..... A47K 3/28 239/332
3,306,566 A * 2/1967 Paulson ..... A47G 19/2261 206/217
3,336,758 A * 8/1967 Williams ..... E21D 20/021 405/259.5
3,377,807 A * 4/1968 Nave ..... E21D 20/021 405/259.4
3,508,282 A * 4/1970 Phillips, Jr. ..... A47K 1/04 4/615
3,527,352 A * 9/1970 De Lapa ..... A47B 13/00 108/29
3,541,798 A * 11/1970 Schnabel, Jr. ..... E02D 17/04 405/262
3,581,317 A * 6/1971 Wright ..... E03C 1/06 4/637
3,621,494 A * 11/1971 Bucher ..... A47K 3/18 4/539
3,756,679 A * 9/1973 Schoenfelder ..... A47K 10/04 108/29
4,103,625 A * 8/1978 Black ..... B60N 3/16 105/439
4,173,325 A * 11/1979 Petrovic ..... B05B 1/1681 239/280
4,268,392 A * 5/1981 Hayes ..... E03C 1/264 210/238
4,336,619 A * 6/1982 Hinkel ..... A47K 10/48 312/228
4,423,529 A 1/1984 Drach
4,761,839 A * 8/1988 Ganaway ..... A47L 17/00 239/289
4,863,103 A * 9/1989 Gannaway ..... C02F 1/003 239/25
4,901,378 A * 2/1990 Reddell ..... A45D 19/08 4/515
4,910,808 A * 3/1990 Roth ..... B65D 83/28 222/182
5,215,201 A 6/1993 Seymour
5,217,123 A * 6/1993 Riley ..... A47K 10/08 211/105.1
5,381,830 A * 1/1995 Niemann ..... E03C 1/0401 137/615
5,390,852 A * 2/1995 Schuenemann ..... A47C 1/14 239/263.1
5,464,533 A * 11/1995 Koslow ..... B01D 15/00 134/111
5,881,404 A * 3/1999 Knight ..... A47K 1/02 4/619
5,884,662 A * 3/1999 Ko ..... E03C 1/04 137/801
5,906,466 A * 5/1999 Eandi ..... E04F 13/0837 411/531
6,305,558 B1 10/2001 Bates
6,355,038 B1 * 3/2002 Pisharodi ..... A61B 17/7043 411/538
6,398,877 B1 * 6/2002 Magliocca ..... B01D 33/11 134/10
6,502,254 B1 * 1/2003 De Menna ..... A47B 77/022 108/25
6,631,525 B2 * 10/2003 Piatt ..... A47K 1/04 4/613
6,959,461 B1 * 11/2005 Sanchez ..... A47J 47/20 4/654
7,325,260 B1 * 2/2008 Hoyt ..... E03C 1/06 4/567
7,328,717 B1 * 2/2008 Hertz ..... E03C 1/021 137/382
8,296,876 B2 10/2012 Yang et al.
8,376,248 B2 * 2/2013 Meisner ..... E03C 1/0404 239/280
8,763,818 B1 7/2014 Pargansky
8,973,763 B2 3/2015 Pargansky
2003/0084937 A1 * 5/2003 Burns ..... F16L 5/06 137/359
2004/0011399 A1 * 1/2004 Segien, Jr. ..... E03C 1/04 137/119.01
2004/0060109 A1 * 4/2004 Hensley ..... E03C 1/04 4/675
2004/0216789 A1 * 11/2004 Benstead ..... E03C 1/04 137/801
2005/0044625 A1 * 3/2005 Kommers ..... E03C 1/18 4/654
2007/0124857 A1 * 6/2007 Milne ..... E03C 1/0404 4/675
2007/0261163 A1 * 11/2007 Lynam ..... A47K 5/1202 4/654
2008/0078020 A1 * 4/2008 Wright ..... E03C 1/186 4/658
2008/0178935 A1 * 7/2008 Thomas ..... E03C 1/023 137/1
2010/0043898 A1 * 2/2010 Eckhaus ..... E03C 1/04 137/625
2010/0175765 A1 * 7/2010 Andersen ..... E03C 1/0404 137/615
2010/0287696 A1 * 11/2010 Lopchinsky ..... E03C 1/186 4/654
2011/0061754 A1 * 3/2011 Thomas ..... E03C 1/04 137/625.29
2011/0089263 A1 * 4/2011 Hughett ..... E03C 1/0404 239/428.5
2013/0025045 A1 * 1/2013 Gagnon ..... A47K 1/04 4/654
2013/0152303 A1 * 6/2013 Brown ..... E03C 1/18 4/638
2013/0180043 A1 * 7/2013 Pickle ..... E03C 1/048 4/626
2013/0199645 A1 * 8/2013 Hsu ..... F16K 19/006 137/801
2013/0283521 A1 * 10/2013 Jain ..... E03C 1/18 4/654
2014/0251930 A1 * 9/2014 Pargansky ..... A47L 19/04 211/16
2016/0088967 A1 3/2016 Moli
2016/0128815 A1 * 5/2016 Birdee ..... A61C 17/0214 433/80
2017/0183847 A1 * 6/2017 Ho ..... E03C 1/0412

* cited by examiner

OVER A SINK RETRACTABLE AND EXTENDABLE TOWEL HANGING APPARATUS

BACKGROUND OF THE INVENTION

1. Field of the Invention

The present invention relates to the field of towel bars for hanging wet towels. More particularly, the present invention relates to a towel bar or hanging apparatus which is selectively retractable and extendable over a water sink whereby water dripping from a towel draped over the towel bar will fall into the sink.

2. Background

Towels are often used over and/or near water sinks, for example, for washing dishware, drying dishware and for other similar known and customary tasks. After use and becoming wet, the towels are typically dried by hanging over a towel bar. Unfortunately, when the towels are excessively wet, water drips therefrom and can stain or otherwise damage the surface there below.

Because such towels are used over and/or near sinks, it would be convenient to provide towel bars which are located near sinks. In this regard, several towel bars have been devised for attachment and use on the front face of the sink or the cabinet supporting the sink and also below the sink within the cabinet supporting the sink. Examples of these towel bars are shown and described in U.S. Pat. No. 5,215,201; U.S. Pat. No. 6,305,558; JP 1999-25333; and, JP 2008-000299.

In connection with towels which become excessively wet, it would be convenient to provide towel bars which are located over the sink whereby water dripping therefrom can simply drip into the sink and drain away. For example, U.S. Pat. No. 8,296,876 discloses a sink organizer mountable within a sink and including towel bars. Also, U.S. Pat. No. 8,973,763, U.S. Pat. No. 8,763,818 and U.S. Pat. No. 4,423,529 disclose dish drying racks and organizers adapted to be used adjacent or within a sink and include towel bars which pivot about a vertical axis and are thereby extendable over the sink. Additionally, US 2016/0088967 and JP 2006-55405 disclose towel bars which are mounted adjacent above and/or to the side of a sink.

Although the prior towel bars which are located near and/or over a sink are generally adequate for their intended purpose, they have shortcomings and drawbacks. Of course, those which are not located over the sink allow excess water to drip from the towel and stain or otherwise damage the surface there below. Also, those which are located adjacent, above and/or within the sink can be unsightly and, if one desires to store them elsewhere, they must be lifted for placement in storage.

Accordingly, a need exists for an improved towel bar apparatus which is easily showable and which provides a means for hanging wet towels over a sink.

SUMMARY OF THE INVENTION

The present invention overcomes disadvantageous of prior towel bars located near and/or over sinks by providing a towel bar/hanging apparatus which is selectively extendable over the sink whereby water dripping from a towel draped over the towel bar will fall into the sink, and is retractable therefrom and stowed below the sink rim and/or the countertop adjacent the sink.

In one form thereof the present invention is directed to a towel hanging apparatus including a sleeve extending through a horizontal surface located adjacent a sink. An elongate arm is slidably received through the sleeve. The elongate arm is selectively slidable through the sleeve above the horizontal surface to an extended position over the sink and is slidable through the sleeve to a retracted position below the horizontal surface. In its extended position, a towel can be draped over the elongate arm and over the sink. In its retracted position, the elongate arm is withdrawn from over the sink.

The sink can be mounted under a hole extending through a horizontally extending counter top comprising the horizontal surface with the sleeve extending through the counter top adjacent the counter top hole. Alternatively, the sink can include a horizontally extending integral rim located above the sink and comprising the horizontal surface with the sleeve extending through the rim.

Preferably, a base flange is provided atop and secured to the horizontal surface and the sleeve is secured to the base flange. The base flange can include a sprayer head hose hole.

The sleeve may include a longitudinal axis which extends perpendicular or at an acute angle relative to the horizontal surface.

The elongate arm can be arcuate shaped and, in its extended position, the elongate arm becomes frictionally engaged with the sleeve. Alternatively, in its extended position, the elongate arm can become magnetically engaged with a magnet adjacent the sleeve.

The elongate arm can comprise an upper link and a lower link. A terminal end of the upper link is hingedly secured to a terminal end of the lower link to thereby form the elongate arm. In the extended position of the elongate arm, the lower link extends transverse to the horizontal surface and the upper link is pivoted about the hinge to extend at an angle relative to the lower link and over the sink, whereby a towel can be draped over the upper link and over the sink. In the retracted position of the elongate arm, the upper link is pivoted about the hinge to extend collinear with the lower link, whereby the upper link is withdrawn from over the sink and both the lower and upper links are slidable through the sleeve to the retracted position below the horizontal surface. Furthermore, the sleeve can include a guide slot including a longitudinally extending slot portion in communication with a transverse extending slot portion. The lower link can include a pin extending transverse therefrom and through the guide slot. In the extended position of the elongate arm, the pin is located in the transverse extending slot portion whereby the elongate arm is prevented from sliding through the sleeve. By rotating the lower link and moving the pin from the transverse extending slot portion into the longitudinally extending slot portion, the pin is free to move along the longitudinally extending slot portion, whereby the elongate arm is free to slide through the sleeve and to its retracted position.

A grip cap can be provided at a top terminal end of the elongate arm for gripping and sliding the elongate arm between its retracted and extended positions.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
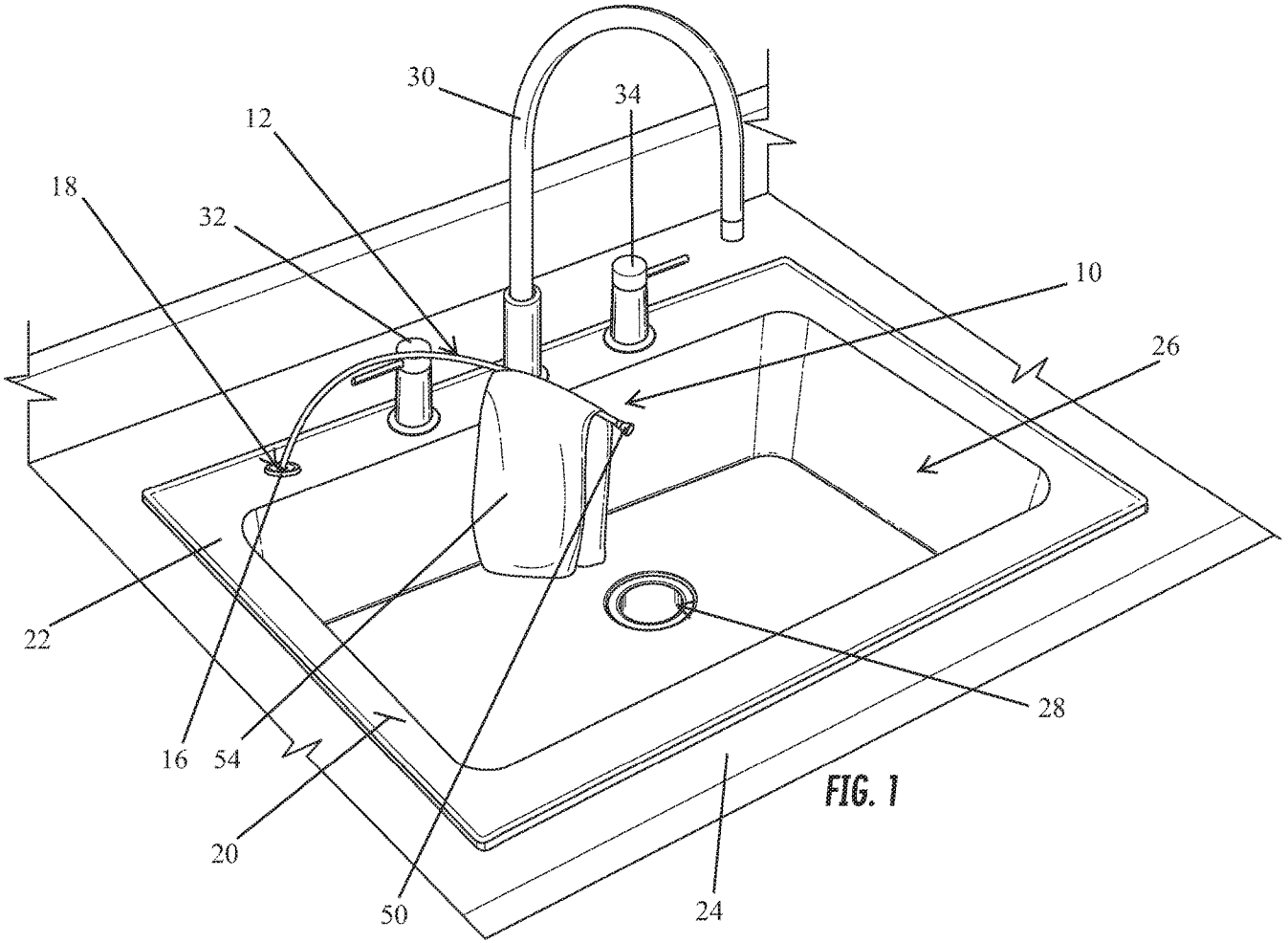
FIG. 1 is a perspective view of a towel hanging apparatus constructed in accordance with the principles of the present invention adjacent a sink and with the elongate arm extending over the sink, and showing a towel draped over the arm and over the sink.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

A towel hanging/bar apparatus constructed in accordance with the principles of the present invention is shown and designated in the drawings with the numeral 10. Towel hanging apparatus 10 includes an elongate arm 12 slidingly received through a sleeve 14. The sleeve 14 extends through and is secured to a base flange 16. The base flange 16 and the top terminal end 18 of the sleeve 14 are located atop of a horizontal surface 20 of a horizontally extending sink rim 22 or a horizontally extending countertop 24. The elongate arm 12, sleeve 14 and base flange 16 are preferably made of stainless steel, steel plated with a n-corroding material such as stainless steel, plastic, etc.

Figure 2:
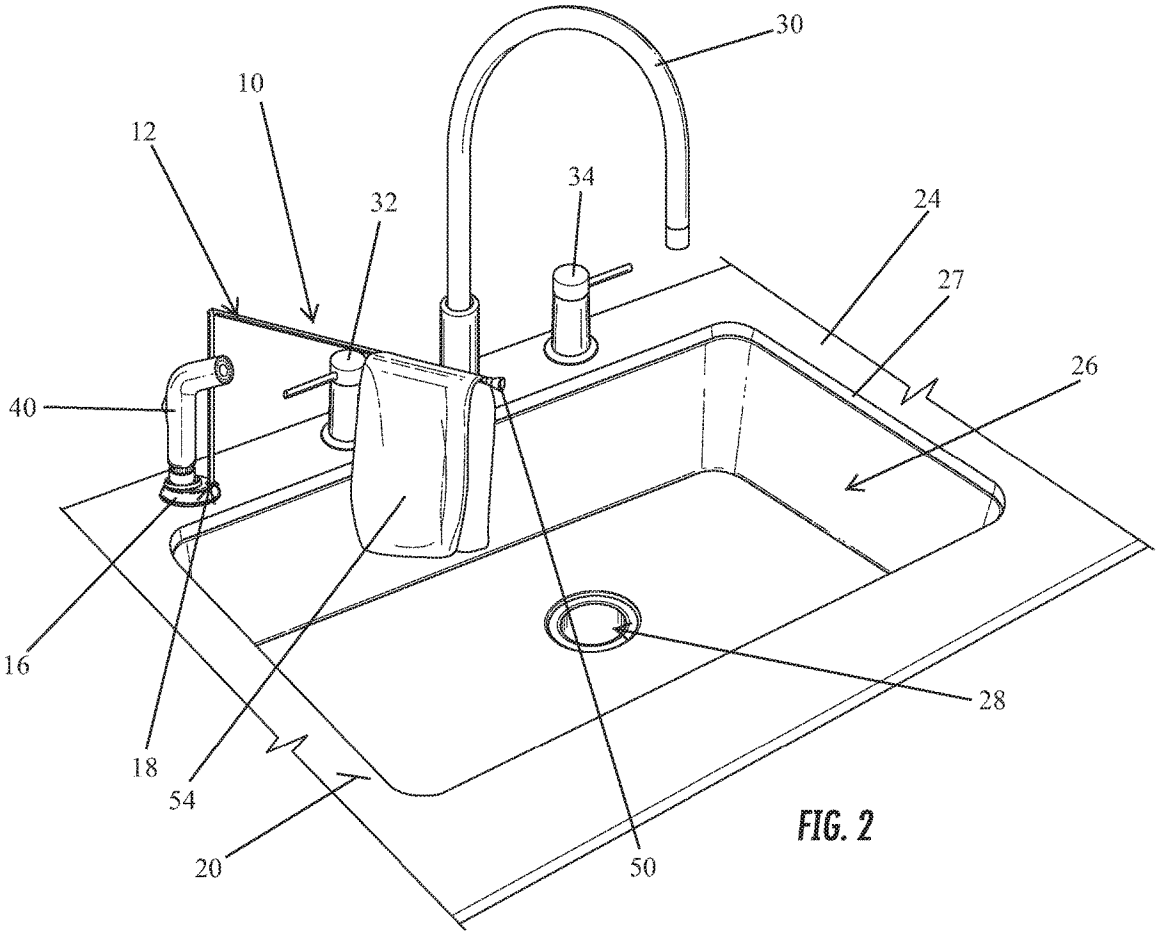
FIG. 2 is a perspective view of another embodiment of a towel hanging apparatus constructed in accordance with the principles of the present invention adjacent a sink and with the elongate arm extending over the sink, and showing a towel draped over the arm and over the sink.

In the embodiment shown in FIG. 1, the sink rim 22 is integrally formed with the sink 26 and the sink rim 22 rests on the countertop 24. In the embodiment of FIG. 2, the sink 26 is mounted to the underside of the countertop 24 under and aligned with a countertop hole 27 formed in and extending through the countertop 24. The sleeve 14 can extend downwardly through holes (not shown) in the sink rim 22 and/or countertop 24 extending thereunder and below the horizontal surface 20. The base flange 16 and top terminal end 18 of the sleeve 14 are located adjacent, preferably less than about five inches from, the sink 26 and/or countertop hole 27. The sink 26 is provided with a drain 28. A faucet 30 and hot and cold water valves 32, 34 are provided and mounted on the sink rim 22 and/or the countertop 24 in a known and customary manner.

As shown in FIGS. 2-10, a sprayer head post 36 can be secured to and/or can be integrally formed with the base flange 16 and extend downwardly therefrom. A sprayer head hose hole 38 extends through the post 36 and is adapted to receive therethrough a sprayer head hose (not shown) which is connected to a sprayer head 40. Sprayer head 40 rests atop the post 36 on the base flange 16 when not in use, as shown in FIG. 2, and can be withdrawn therefrom along with the sprayer head hose for use in a known and customary manner.

As shown in the embodiment of FIGS. 2-8, the lower end of the sprayer head post 36 can be threaded and adapted to threadingly receive a threaded nut 42 thereon. As should now be appreciated, the towel hanging apparatus 10 can be mounted atop the horizontal surface 20 by extending the threaded post 36 through a hole (not shown) in the sink rim 22 and/or countertop 24 and clamping the sink rim 22 and/or the countertop 24 between the base flange 16 and the nut 42.

Figure 9:
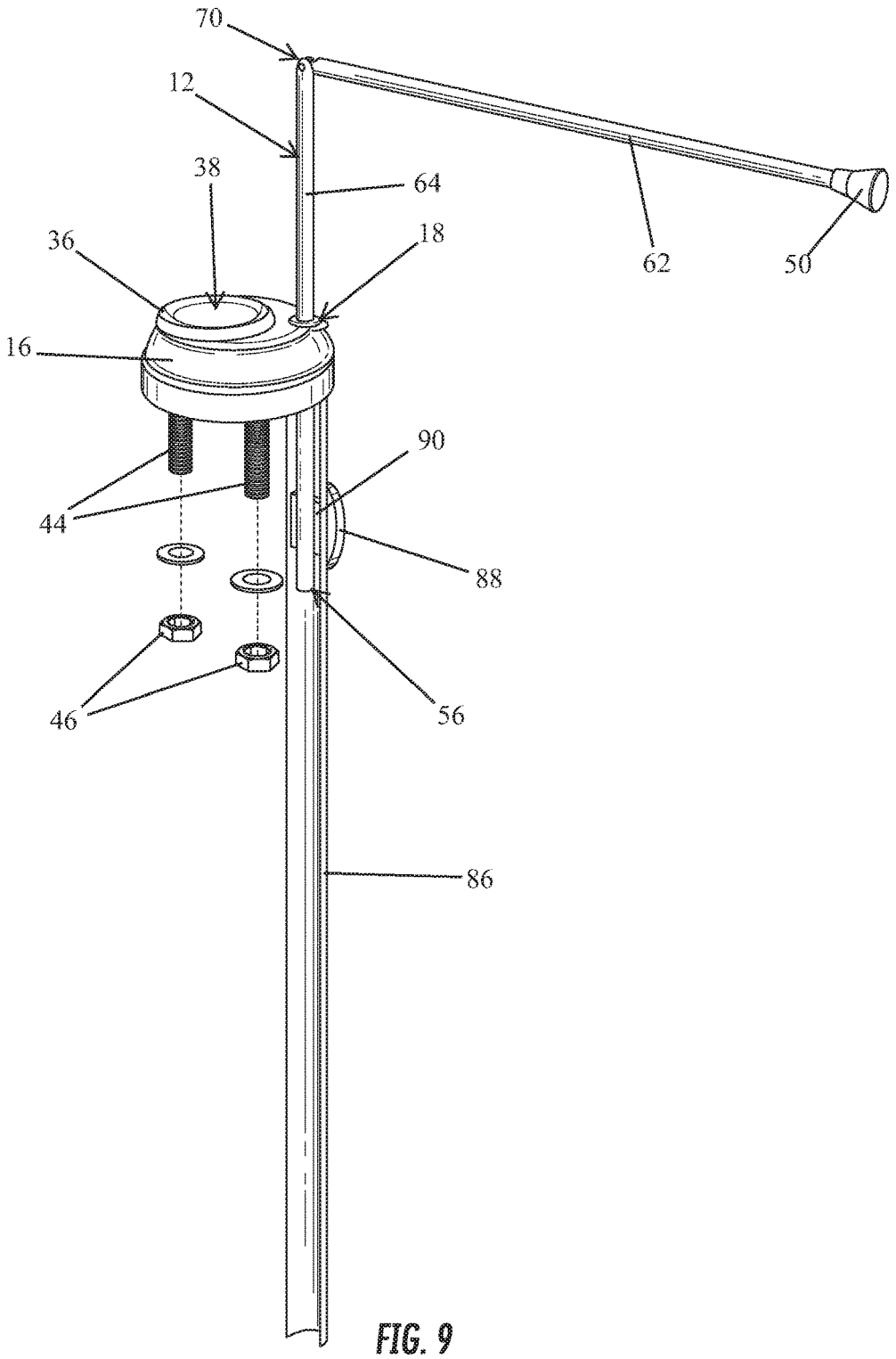
FIG. 9 is a perspective view of another embodiment of a towel hanging apparatus constructed in accordance with the principles of the present invention and with its elongate arm in its extended position.
Figure 10:
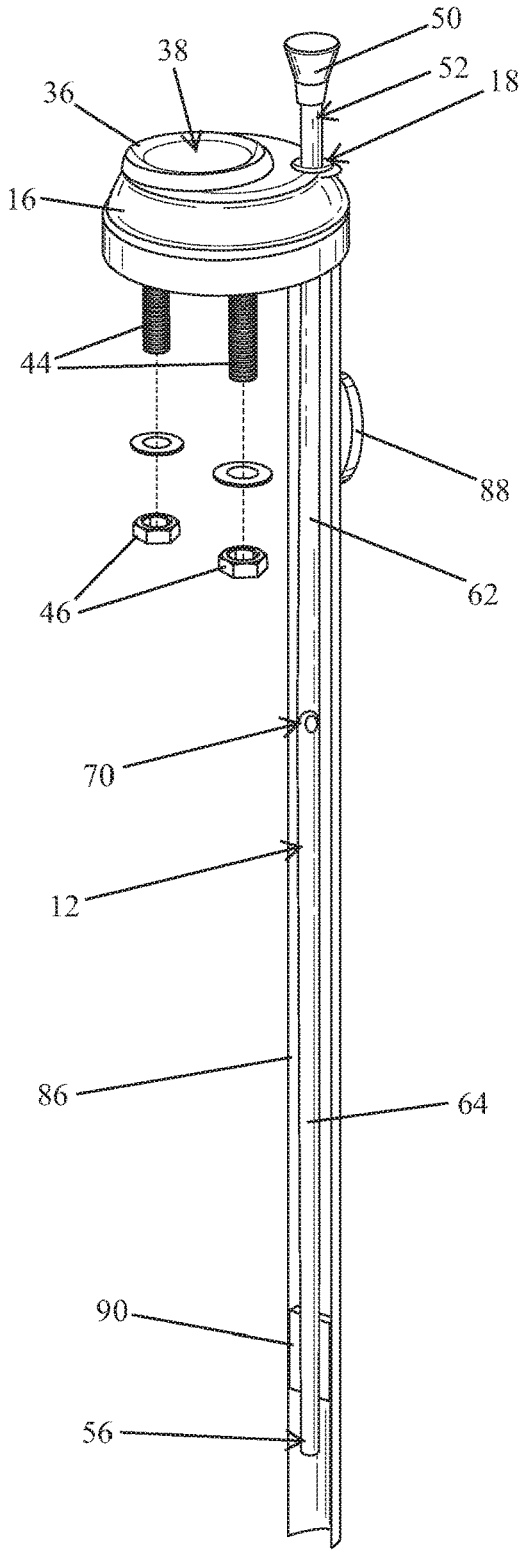
FIG. 10 is a perspective view of the towel hanging apparatus shown in FIG. 9 with the elongate arm in its retracted position.

As shown in the embodiment of FIGS. 9-10, one or more threaded fastener posts 44 can be secured to and/or integrally formed with the base flange 16 and extend downwardly therefrom. Fastener posts 44 are adapted to threadingly receive threaded nuts 46 thereon. As should now be appreciated, the towel hanging apparatus 10 can be mounted atop the horizontal surface 20 by extending the threaded fastener posts 44 through holes (not shown) in the sink rim 22 and/or countertop 24 and clamping the sink rim 22 and/or the countertop 24 between the base flange 16 and the nuts 46.

Figure 11:
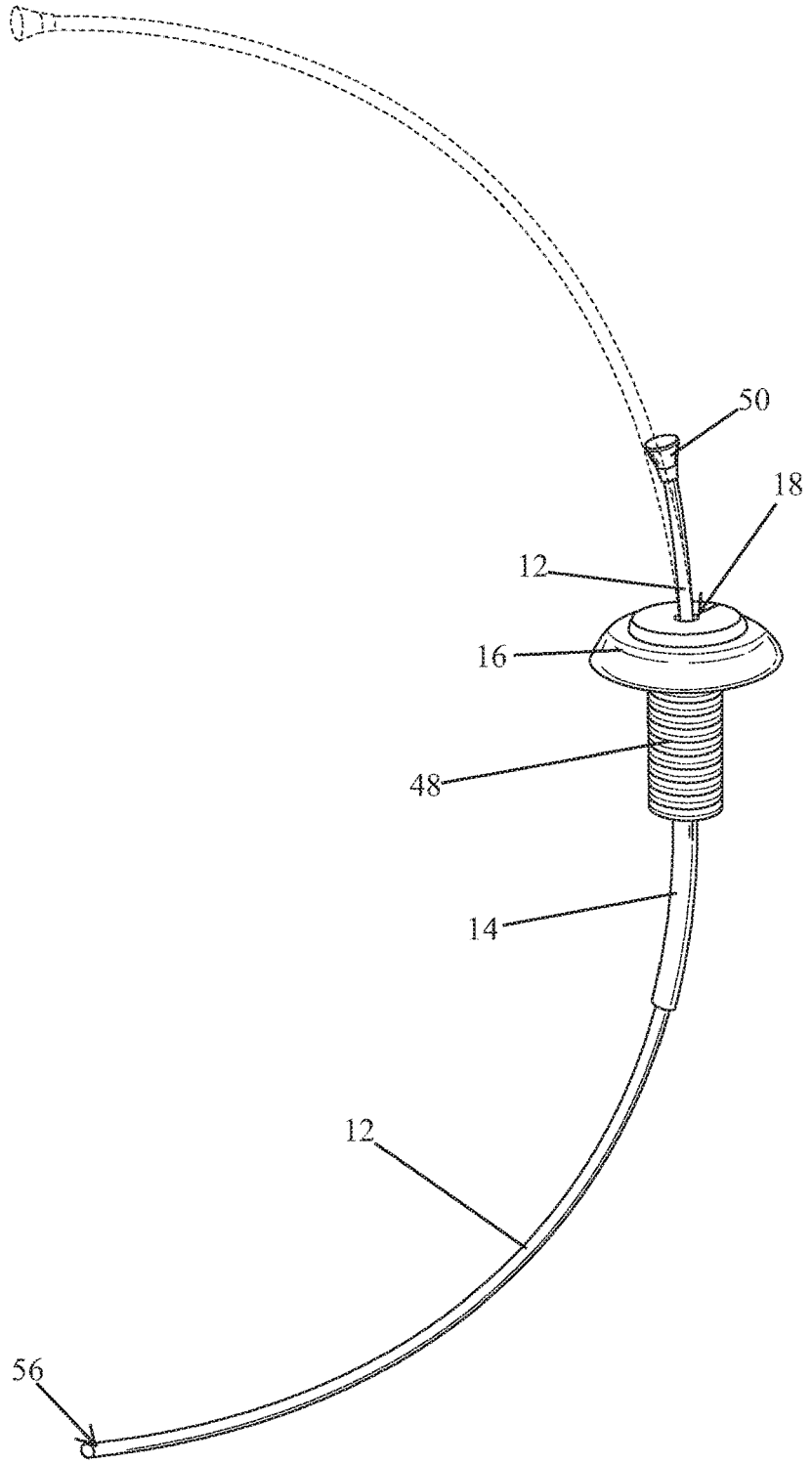
FIG. 11 is a perspective view of the towel hanging apparatus shown in FIG. 1 and showing the elongate arm in its extended position in dash lines; and, FIG. 12 is a perspective view similar to FIGS. 1 and 2 and showing the elongate arm in its retracted position.

As shown in the embodiment of FIG. 11, a threaded sleeve 48 can be secured to and/or integrally formed with the base flange 16 and circumscribing the elongate arm sleeve 14. Threaded sleeve 48 extends downwardly from the flange base 16. Threaded sleeve 48 is adapted to threadingly receive a threaded nut 42 (not shown in FIG. 11 for clarity). As should now be appreciated, the towel hanging apparatus 10 can be mounted atop the horizontal surface 20 by extending the threaded sleeve 48 through a hole (not shown) in the sink rim 22 and/or countertop 24 and clamping the sink rim 22 and/or the countertop 24 between the base flange 16 and a nut 42.

Figure 8:
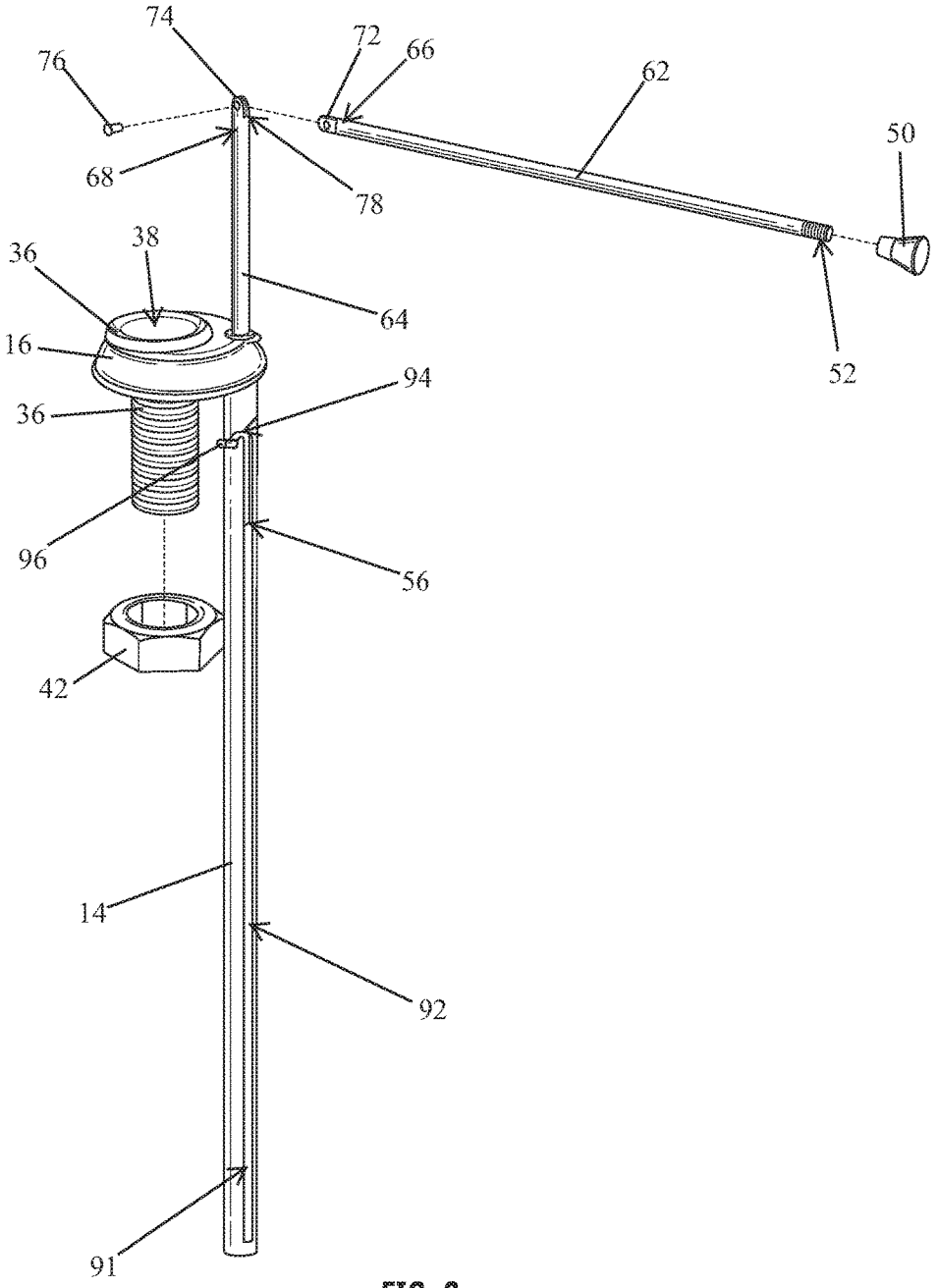
FIG. 8 is a perspective exploded view of the towel hanging apparatus shown in FIG. 5.

A grip cap 50 can be integrally formed with or secured to the top terminal end 52 of the elongate arm 12 in a known and customary manner. Preferably, as shown in FIG. 8, the top terminal end 52 of the elongate arm 12 is threaded and is threadingly received in a threaded bore (not shown) extending into the grip cap 50.

Figure 12:
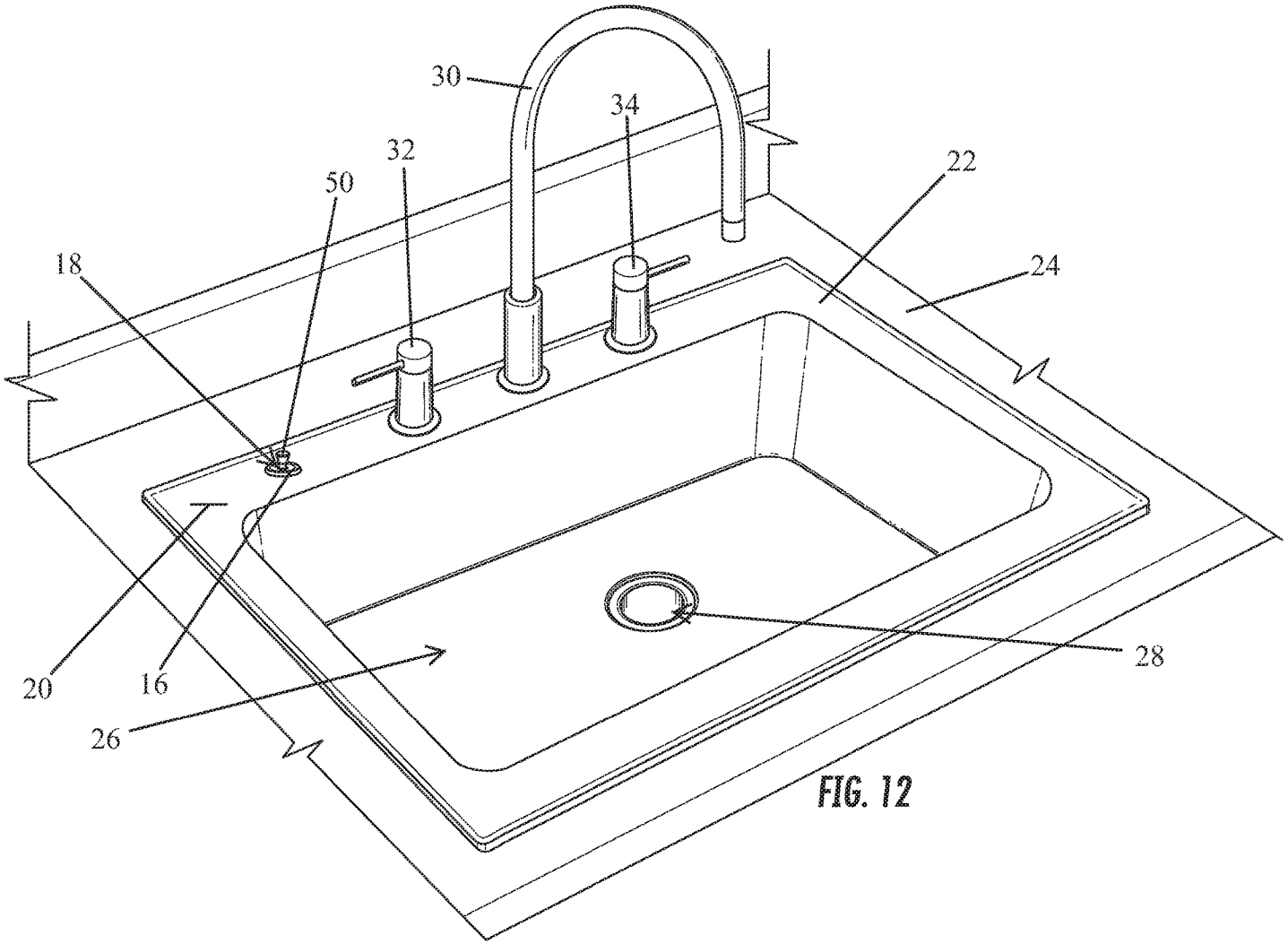

The outer surface shape of the elongate arm 12 is the same as/a mirror image of the longitudinal bore shape of the sleeve 14. Preferably, the elongate arm 12 is rod shaped and the longitudinal bore of sleeve 14 is circular as shown in the drawings, although it is contemplated that other correspondingly similar shapes can be used e.g., square, hexagonal, etc. The elongate arm 12 is sized to snugly fit within the longitudinal bore of the sleeve 14 and to generally freely slide therethrough. Accordingly, as should now be appreciated, by gripping and pulling or pushing the grip cap 50 longitudinally along the elongate arm 12, the elongate arm 12 can be selectively slid through the sleeve 14 and placed in an extended position above the horizontal surface 20 and extending over the sink 26 as shown in FIGS. 1 and 2, and can be placed in a retracted position below the horizontal surface 20 of the sink rim 22 and/or countertop 24 as shown in FIG. 12. In its extended position, a towel 54 and/or other articles can be draped over the elongate arm 12 and any water dripping therefrom hills into the sink 26. In its retracted position, the elongate arm 12 is stowed underneath the countertop surface 20 and is out of the way for conducting other tasks over the sink as may be needed or desired.

Figure 3:
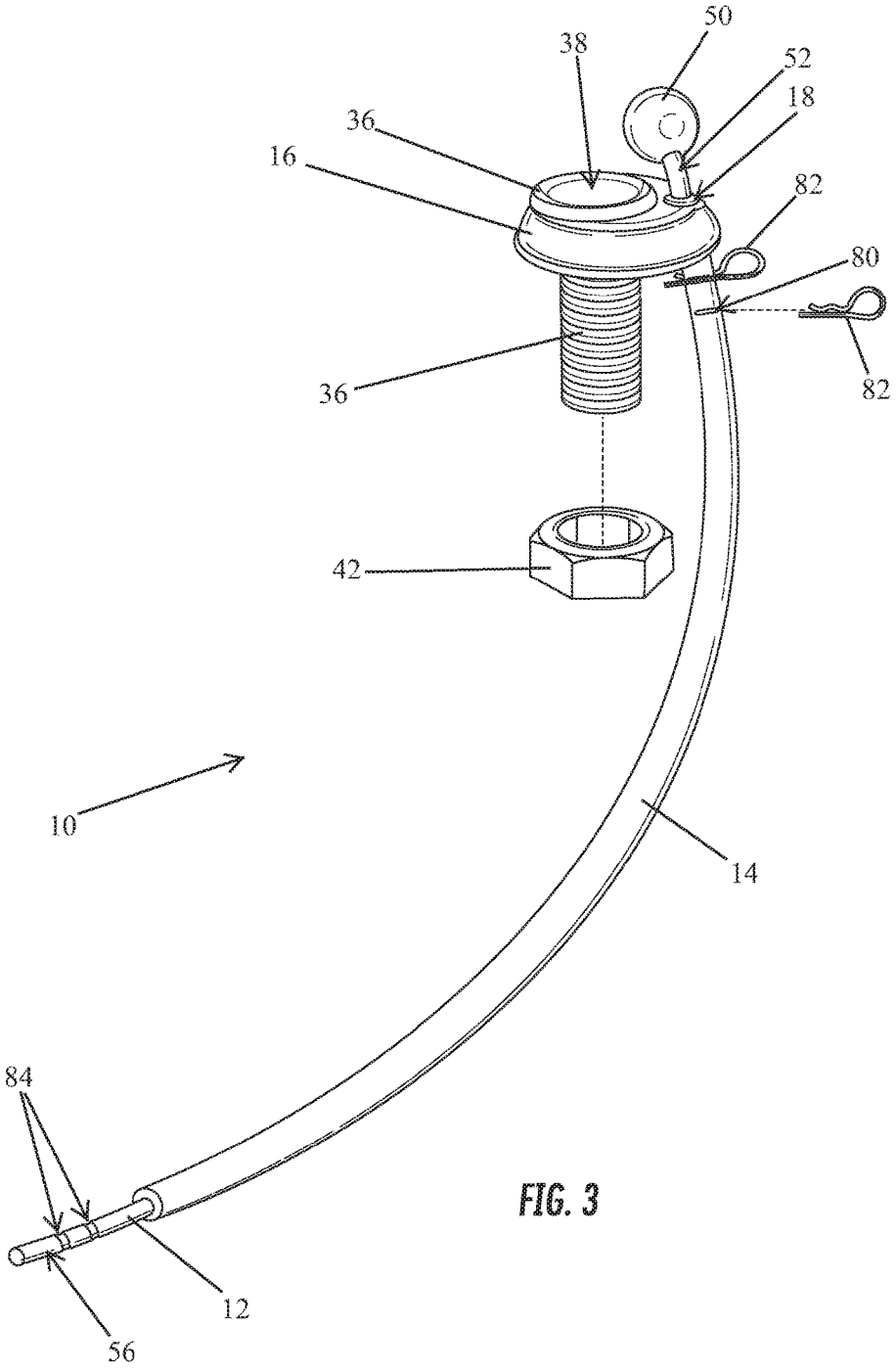
FIG. 3 is a perspective view of the towel hanging apparatus shown in FIG. 1 with the elongate arm in its retracted position and including a sprayer head hose hole.
Figure 4:
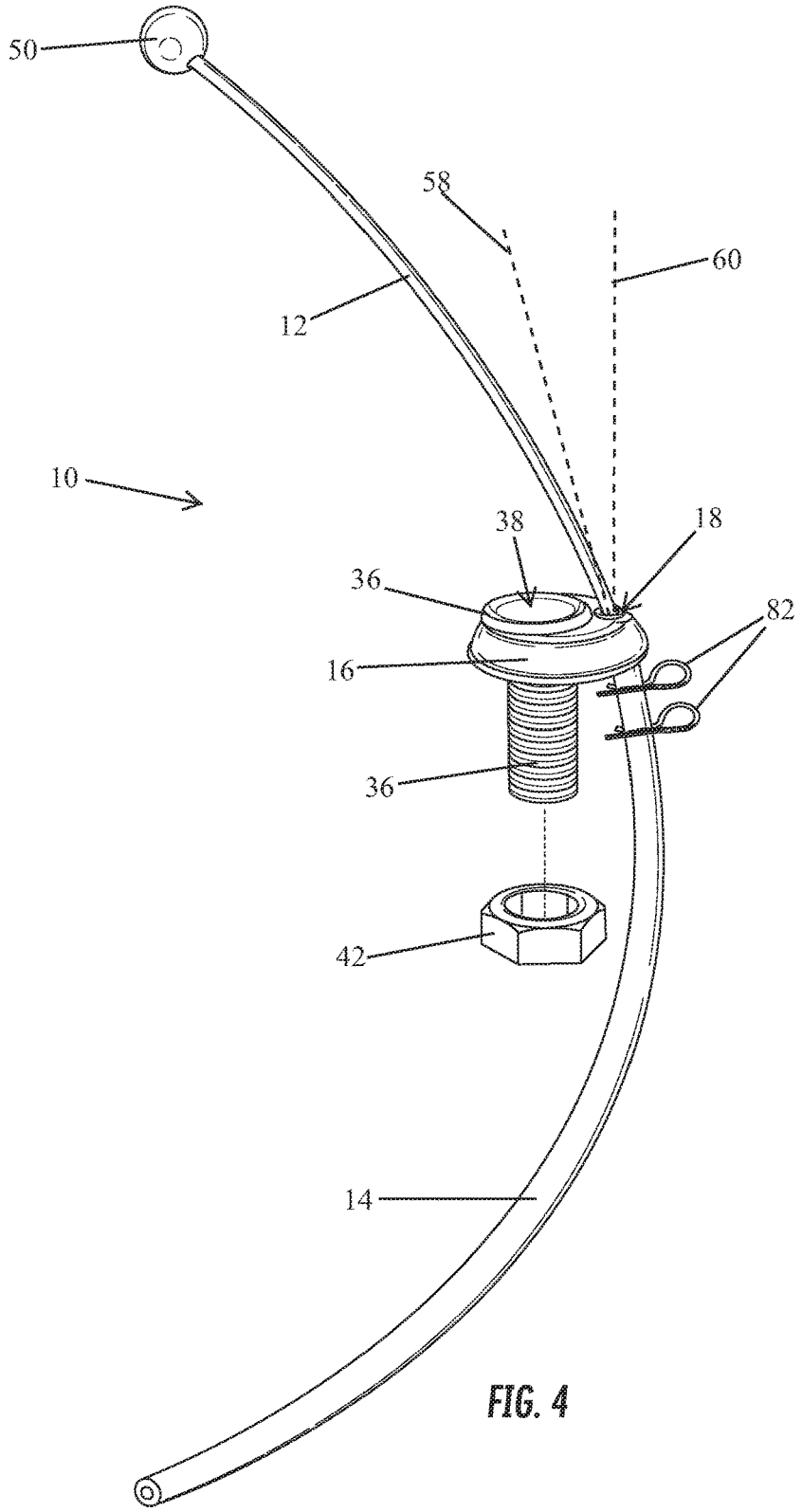
FIG. 4 is a perspective view of the towel hanging apparatus shown in FIG. 3 with the elongate arm in its extended position.

The elongate arm 12 can be a single elongate arcuate shaped rod as shown in FIGS. 1, 3, 4 and 11 extending from its top terminal end 52 to its lower terminal end 56. Of course, sleeve 14 is correspondingly arcuate shaped as shown for freely slidingly receiving the arcuate arm. Although not necessary, as shown in FIG. 4, when the elongate arm 12 is arcuate shaped, the longitudinal axis 58 of the top terminal end 18 of sleeve 14 preferably extends at an acute angle relative to the horizontal surface 20 and the vertical axis 60. Accordingly, in its extended position, the elongate arm 12 will extend over the sink 26 as shown in FIG. 1. It is also contemplated that the elongate arm can be linear shaped with the entire sleeve 14 extending at an acute angle relative to the horizontal surface 20 and to the vertical axis 60, as depicted by axis 58, such that the elongate arm 12 will again extend over the sink 26 when in its extended position.

As shown in FIGS. 2 and 5-10, the elongate arm 12 can comprise an upper link 62 and a lower link 64. The lower terminal end 66 of the upper link 62 is hingedly secured to the upper terminal end 68 of the lower link 64 and thereby form a hinge connection 70.

Figure 6:
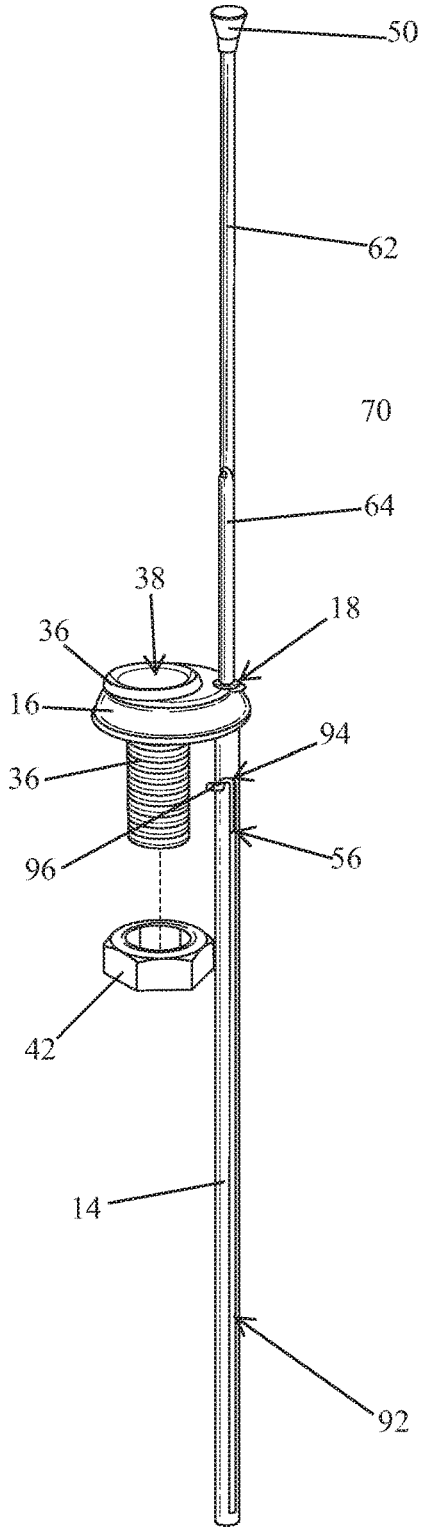
FIG. 6 is a perspective view of the towel hanging apparatus shown in FIG. 5 with the elongate arm upper link pivoted and collinear with the elongate arm lower link.

Preferably, hinge connection 70 comprises a single blade 72 at the lower terminal end 66 of the upper link 62 which is received between a pair of arms 74 at the upper terminal end 68 of the lower link 64. A hinge pin 76 extends through aligned holes in the blade 72 and arms 74 for thereby pivotally securing the upper and lower links 62, 64 to one another. The terminal end 66 of upper link 62 is rounded and a flat 78 is provided between the arms 74 of lower link 64. Hence, the upper link 62 can be pivoted to a position collinear with the lower link 64 as shown in FIG. 6. However, when pivoting the upper link 62 to a position transverse or at an angle from the lower link 64, the blade 72 abuts the flat 78 thereby limiting the pivotal travel between the upper and lower links 62, 64, and the upper link 62 is maintained transverse and/or at any desired angle relative to the lower link 64.

Figure 5:
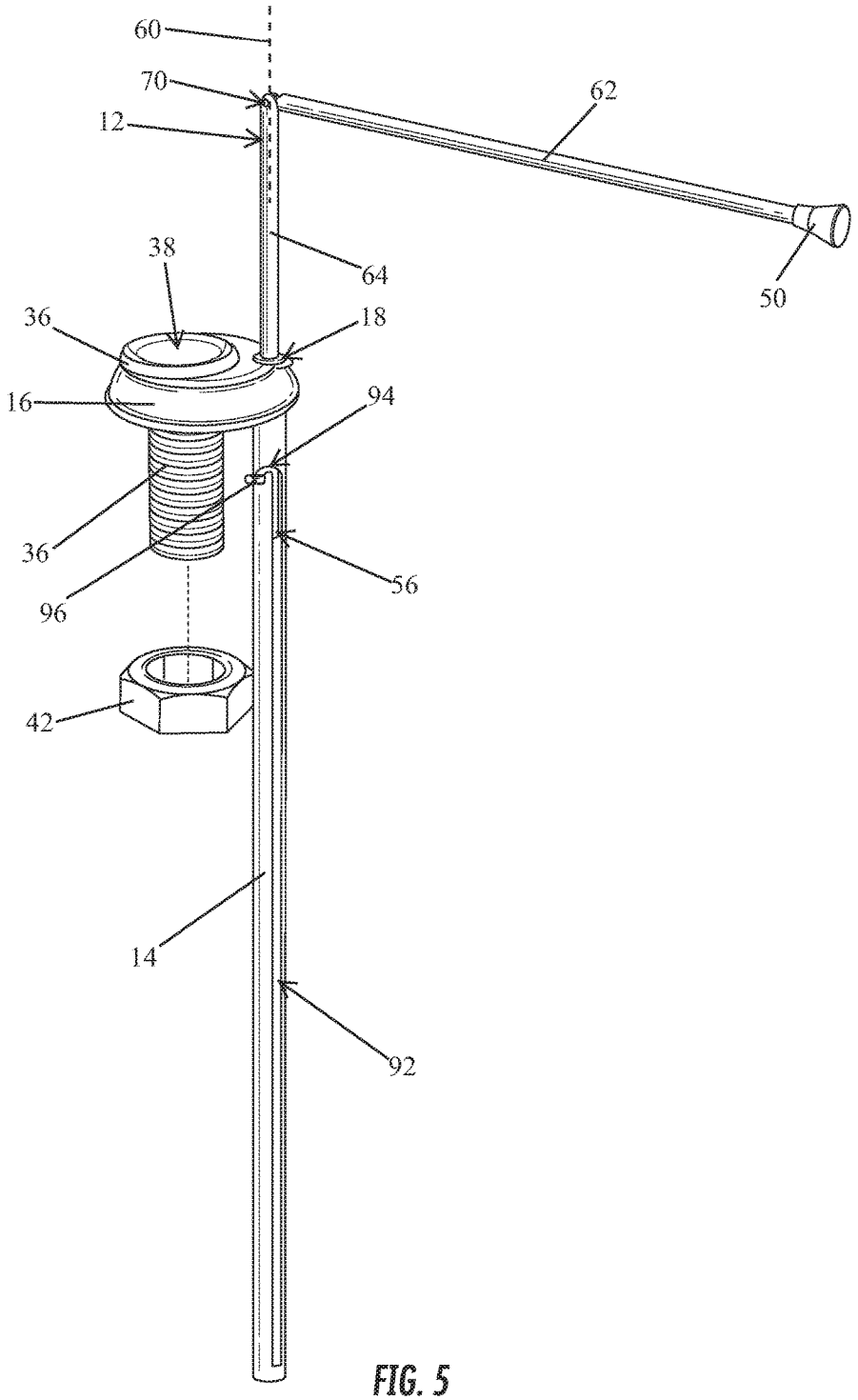
FIG. 5 is a perspective view of the towel hanging apparatus shown in FIG. 2 with the elongate arm in its extended position.

As should be now be appreciated and as shown in FIGS. 2 and 5, in the extended position of the elongate arm 12, the lower link 64 extends transverse to the horizontal surface 20 and vertically along the vertical axis 60, and the upper link 62 is pivoted about the hinge connection 70 and is maintained at an angle relative to the lower link 64 for thereby extending over the sink 26 and supporting a towel 54 draped thereover. For placing the elongate arm 12 in the retracted position, the upper link 62 is pivoted about the hinge connection 70 so as to be collinear with the lower link 64 as shown in FIG. 6. Both lower and upper links 64, 62 are then pushed/slid into the sleeve 14 thereby lowering and placing them into the sleeve 14 in the retracted position below the horizontal surface 20 as shown in FIG. 12.

Various means can be provided, when the elongate arm 12 is placed in its extended position, to maintain the elongate arm 12 in that position and prevent it from unintentionally falling back into its retracted position. For example, in the embodiment shown in FIG. 11, the outer diameter of the elongate arm 12 is sized to tightly fit within the longitudinal bore of the sleeve 14 and to thereby provide a frictional engagement therebetween. Accordingly, the frictional engagement must be overcome when pushing or pulling the elongate arm 12 to slide it between its extended and retracted positions. However, when the elongate arm 12 is in its extended position, the frictional engagement prevents the arm from unintentionally sliding back to its retracted position.

A frictional engagement is also provided in the embodiment of FIGS. 3 and 4. Here, the sleeve 14 is provided with pairs of through slots 80 and spring wire hairpin cotters 82 are clipped onto the sleeve at the slots 80. The slots are sized such that the hairpin cotters 82 project into the longitudinal bore of the sleeve 14. Annular recesses 84 are provided on the surface of the elongate arm 12 near its lower terminal end 56. As should now be appreciated, the hairpin cotter portions projecting into the longitudinal bore of the sleeve 14 normally slide over the exterior surface of the elongate arm 12. However, when the elongate arm 12 is pulled up into its extended position, the hairpin cotter projecting portions snap into and engage their corresponding annular recess 84. Accordingly, when the elongate arm 12 is in its extended position, this frictional engagement can also prevent the arm from unintentionally sliding back to its retracted position.

In the embodiment of FIGS. 10 and 11, a U-shaped channel 86 made of a nonferromagnetic material is secured to the base flange 16 and extends downwardly adjacent the elongate arm 12. A magnet 88 is secured to the back/outside surface of the channel 86 near the base flange 16. A block 90 made of ferromagnetic material is secured to the elongate arm 12 near its lower terminal end 56. Accordingly, when the elongate arm 12 is pulled up into its extended position, the magnet 88 attracts/becomes magnetically engaged with and pulls the ferromagnetic block 90 against the channel 86 and, hence, prevents the arm from unintentionally sliding back to its retracted position.

Figure 7:
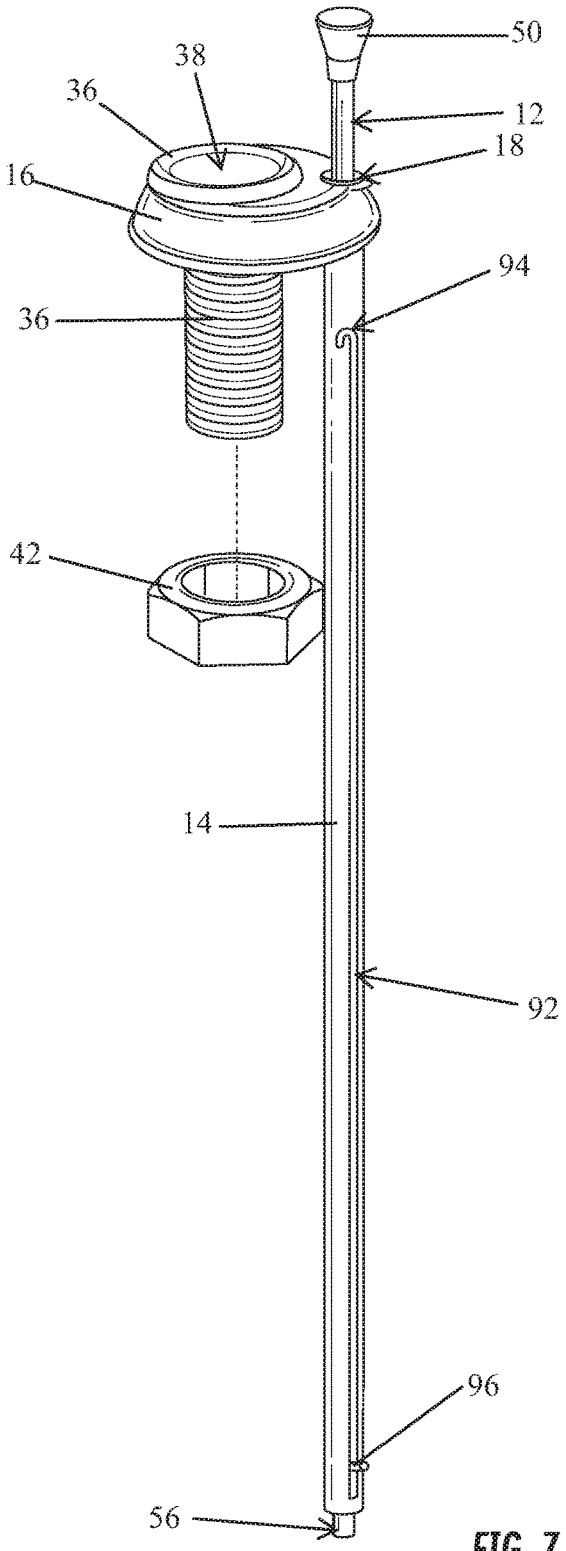
FIG. 7 is a perspective view of the towel hanging apparatus shown in FIG. 5 with the elongate arm in its retracted position.

In the embodiment of FIGS. 5-8, the sleeve 14 includes a guide slot 91 which extends into its elongate bore and which comprises a longitudinally extending slot portion 92 in communication with a transverse extending slot portion 94. The transverse extending slot portion 94 can be "hook" shaped as shown and this shape is considered to be equivalent and encompassed herein by the term "transverse extending" shape. A pin 96 is secured to the elongate arm 12 near its lower terminal end 56 and projects transverse therefrom. The pin 96 is aligned with and extends through the guide slot 91. As should now be appreciated, when the pin 96 is located in the longitudinally extending slot portion 92, the elongate arm 12 is free to move longitudinally therealong for slidingly moving the elongate arm through the sleeve 14 and between its retracted and extended positions. However, when the pin 96 is located in the transverse extending slat portion 94, the elongate arm 12 is prevented from unintentionally moving longitudinally from its extended position as shown in FIG. 5 to its retracted position as shown in FIG. 7. For stowing the elongate arm 12 after it has been placed in its extended position as shown in FIG. 5, the upper link 62 is pivoted about the hinge connection 70 and placed collinear with the lower link 64 as shown in FIG. 6. The elongate arm 12/both links 62, 64 are then pivoted about the vertical axis 60 thereby moving the pin 96 from the transverse extending slot portion 94 into the longitudinally extending slot portion 92, and slidingly lowering and placing the elongate arm 12 in the retracted position below the horizontal surface 20 as shown in FIGS. 7 and 12.

While this invention has been described as having an exemplary design, the present invention may be further modified within the spirit and scope of this disclosure. This application is therefore intended to cover any variations, uses, or adaptations of the invention using its general principles.

What is claimed is:

1. A towel hanging apparatus comprising:

an arcuately shaped sleeve extending through a horizontal surface located adjacent a sink;

an elongate arm, wherein a substantial portion of the elongate arm is slidably received through said sleeve, wherein the substantial portion of the elongate arm is fabricated from a rigid material and is arcuately shaped;

wherein said elongate arm is selectively slidable through said sleeve to an extended position above said horizontal surface and over said sink and is slidable through said sleeve to a retracted position below said horizontal surface;

a frictional engagement between said elongate arm and said sleeve whereby, in its extended position, said elongate arm is frictionally engaged with said sleeve and is maintained in its extended position with said sleeve, and whereby a pushing or pulling force is required along said elongate arm to overcome said frictional engagement and sliding said elongate arm from its extended position through said sleeve to its retracted position; and, wherein, in its extended position, a towel can be draped over said elongate arm and over said sink and, in its retracted position, said elongate arm is withdrawn from over said sink.

2. The towel hanging apparatus of claim 1, wherein said sink includes a bottom surface and a horizontally extending integral rim located above the bottom of the sink; wherein the rim comprises said horizontal surface, and said sleeve extends through said rim.

3. The towel hanging apparatus of claim 1, further comprising a base flange atop and secured to said horizontal surface and wherein said sleeve is secured to said base flange.

4. The towel hanging apparatus of claim 1, further comprising a base flange atop and secured to said horizontal surface, said base flange including a sprayer head hose hole; wherein said sleeve is secured to said base flange.

5. The towel hanging apparatus of claim 1, further comprising a grip cap at a top terminal end of said elongate arm for gripping and slidingly pushing or pulling said elongate arm between the retracted position and the extended position.

* * * * *